US006226799B1

(12) United States Patent
Lane

(10) Patent No.: US 6,226,799 B1
(45) Date of Patent: May 8, 2001

(54) SCARF

(76) Inventor: Barry Lane, 461 Colvin Dr., Locust Grove, GA (US) 30248

( * ) Notice: Subject to any disclaimer, the term of this patent is extended or adjusted under 35 U.S.C. 154(b) by 0 days.

(21) Appl. No.: 09/576,742

(22) Filed: May 23, 2000

(51) Int. Cl.[7] ..... A41D 23/00
(52) U.S. Cl. ..... 2/207
(58) Field of Search ..... 2/207, 206, 91

(56) References Cited

U.S. PATENT DOCUMENTS

| | | | | |
|---|---|---|---|---|
| D. 108,019 | | 1/1938 | O'Hara . | |
| D. 339,676 | | 9/1993 | Geving | D2/500 |
| D. 368,571 | | 4/1996 | Worku | D2/500 |
| 866,752 | * | 9/1907 | Way | 2/91 |
| 985,441 | | 2/1911 | Neuman . | |
| 1,405,744 | | 2/1922 | Sampliner . | |
| 1,567,931 | | 12/1925 | Epler . | |
| 1,586,077 | | 5/1926 | Evans . | |
| 1,616,961 | | 2/1927 | Carter . | |
| 1,957,967 | * | 5/1934 | Kirkland | 2/91 |
| 3,678,936 | | 7/1972 | McCormick | 128/402 |
| 3,748,661 | | 7/1973 | Smith | 2/207 |
| 3,889,684 | | 6/1975 | Lebold | 128/402 |
| 4,576,169 | | 3/1986 | Williams | 128/402 |
| 4,641,655 | | 2/1987 | Abt | 128/380 |
| 4,654,897 | | 4/1987 | Rosaen | 2/207 |
| 4,771,479 | | 9/1988 | Silver | 2/85 |
| 5,253,369 | | 10/1993 | Patterson, Jr. | 2/207 |
| 5,802,618 | | 9/1998 | Mustata | 2/207 |

FOREIGN PATENT DOCUMENTS 718686 9/1965 (CA) .

* cited by examiner

*Primary Examiner*—John J. Calvert
*Assistant Examiner*—Alissa L. Hoey
(74) *Attorney, Agent, or Firm*—Holland & Knight LLP

(57) ABSTRACT

An improved scarf comprising a back portion having an upper end and a lower end where the chest portion is integrally connected relative to the upper end of the back portion and the neck portion is integrally connected to the chest portion thereby providing coverage of a person's neck, upper chest and back without a conventional knot.

16 Claims, 4 Drawing Sheets

SCARF

BACKGROUND OF THE INVENTION

1. Field of the Invention

The present invention relates to an article of wearing apparel, and more particularly to scarves and the like.

2. Description of the Background Art

Scarves or mufflers have long been used for both decorative and utilitarian purposes. Most often, a scarf comprises an elongated piece of woven cloth having a length substantially longer than the circumference of the wearer's neck, and a uniform width larger than the vertical extent of the neck. The scarf is knotted or wrapped about the neck, so as to cover the neck and protect it from inclement weather.

Decorative scarves are usually constructed from substantially thinner material than are utilitarian scarves, but are similarly draped about the body. Known scarves are made from a very wide assortment of materials and are worn in a wide variety of styles, including conventional neck scarves, head wraps, head bows, shoulder wraps and as shawls or stoles.

Several disadvantages exist with the traditional scarf design. First, the scarf dimensions are generally inadequate to meet a particular users needs. For example, a scarf may be too wide or too narrow for the user thereby leading to failure in protecting adequately from the ravages of cold or wind. The scarf may also be too long, leading to unwanted excess bulkiness when the scarf is tied, or too short such that the user does not have enough length for covering and tying at the same time.

Several attempts have been made to modify the traditional scarf design and make it user friendly. For example, U.S. Pat. No. 4,654,897, the tailless neck scarf, provides the user with a substantially tailless scarf for the neck, tied by a fastener. The fastener is located in the front portion of the same. Although this design solves some of the problems associated with the extra scarf length and ease of tying, it continues to be limited in that it leaves a portion of the neck exposed to cold air. This is because the fastening devices are at the front ends of the scarf, and upon tying the same there will be a portion of the neck adjacent to the top of the users chest remaining unprotected. This area is located directly below the fastener. Tapering the ends, as suggested in the patent, will tend to worsen the problem, leaving a greater area of the neck to be exposed to the elements. Even if the scarf described in this patent was wide enough to cover the totality of the users neck, the weak point at the base of the neck would still render this design faulty, since cold air leaking through the weak spot would eventually penetrate to all the neck area. Given the lesser surface area of contact used in hook and loop type fasteners, the air leak at the base of the neck will become an even greater problem.

Another less than ideal aspect of the above patent's design is that cold wind hitting the user directly in front would tend to have a lifting effect on the scarf, particularly in the bottom of the piece (at the base of the neck) that is caused by the users chest not being aerodynamic. This will cause the scarf to be unstable, necessitating something to hold it in place. If not held in place, this effect will tend to exacerbate the lifting of the proposed design.

Moreover, the smaller tail, as proposed in this application, may become a nuisance to the wearer because the end tends to stick up when tightened completely. Thus the user will end up with a flap rather than a tail to contend with. Coupled with the lifting aspects already discussed, the user is left with the same original problem, how to completely and effectively cover himself.

Additionally, this design will fail because the cold air may leak through the fastening device itself and reach the users body. This is because the fastener constitutes an area of weakness in the piece itself, and the lack of material continuity allows the cold air to move inwards through the seal (fastener) as any fluid would do.

Pat. No. DES 108,019, design for a scarf, is another attempt to modify the traditional scarf design. This design incorporates the qualities of no tying. However, it is has no provision for holding the scarf in place.

Pat. No. DES 339,676, the facial scarf, is another attempt to modify the traditional scarf design. This design incorporates the qualities of no tail and ease of tying. However, it is held in place by the contact produced by the nose of the user and scarf. Given normal head motion or accelerated neck and head motion, the contact above stated may be reduced or eliminated causing the scarf to fail. Further, too much tension in the scarf may be uncomfortable for the users nose. Additionally, the design does not incorporate any chest protection. Thus, should the user want to wear neck and chest protection only, it would not be possible with this design.

Pat. No. DES 368,571, the scarf, involves an ornamental design for a traditional scarf. Therefore, it is subject to the same limitations as are traditional scarves.

U.S. Pat. No. 985,441, the neck, back, throat, and chest protector, also improves on traditional designs. It provides for the qualities of no tail and ease of tying. However, when this scarf is worn, some cold air would leak through the front of the device because the scarf material for the chest region is not properly integrally meshed to the neck portion.

U.S. Pat. No. 1,405,744, the neck garment, also improves on traditional designs. It provides for the ease of tying. However, the scarf still has unsightly ends.

U.S. Pat. No. 1,586,077, the combined muffler and scarf, also improves on traditional designs. It provides for the qualities of no tail and ease of tying. However, this scarf offers no protection for the person's neck.

U.S. Pat. No. 3,748,661, the adjustable scarf, also improves on traditional designs. It provides for an adjustable scarf, meaning that the tension in the scarf can be adjusted by means of a split ring. This design is essentially a neck only scarf and does not address the issue of chest protection. Further, when this scarf is worn, some cold air would leak through the front of the device because the ring causes the scarf material to compress in front, thus weakening the protection afforded by the device to a portion of the neck.

U.S. Pat. No. 4,771,479, the article clothing, also improves on traditional designs. This design is essentially an article clothing that incorporates a detachable scarf. The scarf requires a conventional knot for tying around the person.

Other designs, such as U.S. Pat. No. 5,253,369, Method of Making a Reversible Scarf with a Visor, pertain to apparel to be worn on the head, rather than the face, neck and chest areas.

U.S. Pat. No. 5,802,618, the neck and chest scarf, also improves on traditional designs. This design is essentially a neck, face and chest scarf and does not address the issue of back protection.

U.S. Pat. No. 4,641,655 discloses a therapeutic cooling wrap designed for tying around the neck of a person. A bag closed by a zipper forms a pouch in a strip of pervious fabric.

The strip of fabric is further stitched to form tying straps on both ends of the pouch. A pad of open-pored foam is secured in the bag to insulate the neck from severe cold still permitting the controlled dispensing of water to the neck area.

U.S. Pat. No. 4,356,709 discloses an ice cap having an inner wall and an outer wall defining a sealed cavity. The inner wall is comprised of an inner laminate of moisture impervious material and an outer laminate of textile material such as cloth. The outer wall is essentially the same.

U.S. Pat. No. 3,889,684 discloses a hot and cold pack which may be secured to the neck by a VELCRO-type fastener.

U.S. Pat. No. 3,678,936 discloses an ice bag comprising two sleeves of rubberized flannel disposed one within the other and sealed. When the zipper is opened, ice is inserted therein.

U.S. Pat. No. 4,576,169 discloses a collar to be worn around the neck for cooling. A towel member encloses an insulating member with a cooling pocket located between the insulating member and the user's neck.

U.S. Pat. Nos. 1,567,931 and 1,616,961 disclose compresses and neck bags containing ice or liquid which are of a different geometrical configuration than that disclosed herein.

Canadian Pat. No. 718,686 discloses an envelope which conforms to fit around the entire neck of a user which contains a particular filling possessing the quality of retaining heat over relatively long periods of time.

None of these patents disclose the structure claimed which is simple and elegant in design, effective in use and can be easily used by man, woman or child.

Tying and arranging conventional scarves is time consuming and may be difficult for those suffering from a debilitation such as arthritis. Also, the knot is, itself, problematic regardless of how the conventional scarf is worn. If the knot is worn in front of a person's neck, it is unattractive and resembles a boy scout kerchief. If the knot is worn behind the person's neck, the knot causes the wearing of a jacket to be uncomfortable. If the knot is worn to one or the other side of the person's neck, a pin must pierce the scarf in order to keep it securely in place.

Therefore, it is an object of this invention to provide an improvement which overcomes the aforementioned inadequacies of the prior art devices and provides an improvement which is a significant contribution to the advancement of the art of scarves.

Accordingly, what is needed in the art is an attractive scarf which is constructed without a knot.

Another object of the present invention is to eliminate the unsightly ends when the scarf is medially knotted.

Yet another object of the present invention is to provide an improved scarf garment which will protect the person's neck and the person's chest while preventing air leakage to the neck or chest region.

Still yet another object of the present invention is to provide a scarf that will easily fit under the person's coat.

Another object of the present invention is to provide an improved scarf which can be adjusted to various sizes so as to conform to a variety of different people.

Yet another object of the present invention is to provide a garment which the person can put on or take off without pulling the garment over his or her head.

Another object of the present invention is to provide a scarf that will easily and simultaneously cover the person's neck, upper chest and back.

Still yet another object of the present invention is to provide a scarf that comprises a back portion that is integrally connected to a chest portion which is integrally connected to a neck portion thereby allowing the present invention to simultaneously cover the person's neck, upper chest and back without the need of a conventional knot.

Another object of the present invention is to provide a back portion which can hold either a warming material or a cooling material against the person's back in an aesthetically pleasing and simple manner.

The foregoing has outlined some of the pertinent objects of the present invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

In accordance with the present invention, there is provided an improved scarf for covering the neck, chest and back of a person without the need for tying a conventional knot.

The present invention is very practical and provides aesthetic protection of the neck, back and chest area. Both sexes of all ages find themselves needing this protection when subjected to cold temperatures and drafty conditions. The invention accomplishes this protection by simultaneously covering the neck, back and chest. The invention is a garment made of virtually any woven fabric, i.e., wool, polyester, etc., and is completely homogeneous in construction. It can be manufactured to accommodate any standard or custom size.

The scarf of the present invention comprises a back portion that is integrally connected to a chest portion which is integrally connected to a neck portion. In use, the present invention simultaneously covers a person's neck, upper chest and back without the need of tying a conventional knot.

Another feature of the present invention is the ability to simultaneously cover a person's neck, upper chest and back without air leakage to the person's neck.

Yet another feature of the present invention is the ability of the person to easily wear a coat over the scarf of the present invention.

Still another feature of the present invention is the ability of the person to easily remove the scarf of the present invention without pulling the garment over his or her head.

In one embodiment of the present invention, the back portion has a pocket for receiving either a heating material or a cooling material. In this manner, the user can provide the desired temperature therapy to their back while wearing an aesthetically pleasing scarf.

In another embodiment of the present invention, the user is able to attach the scarf of the present invention to their body through the use of Velcro®, snaps, hooks, loops, buttons, zippers and other known fasteners.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The invention will become more readily apparent from the following description of preferred embodiments thereof shown, by way of example only, in the accompanying drawings wherein.

Similar reference characters refer to similar parts throughout the several views of the drawings.

DETAILED DESCRIPTION OF THE INVENTION

Figure 1:
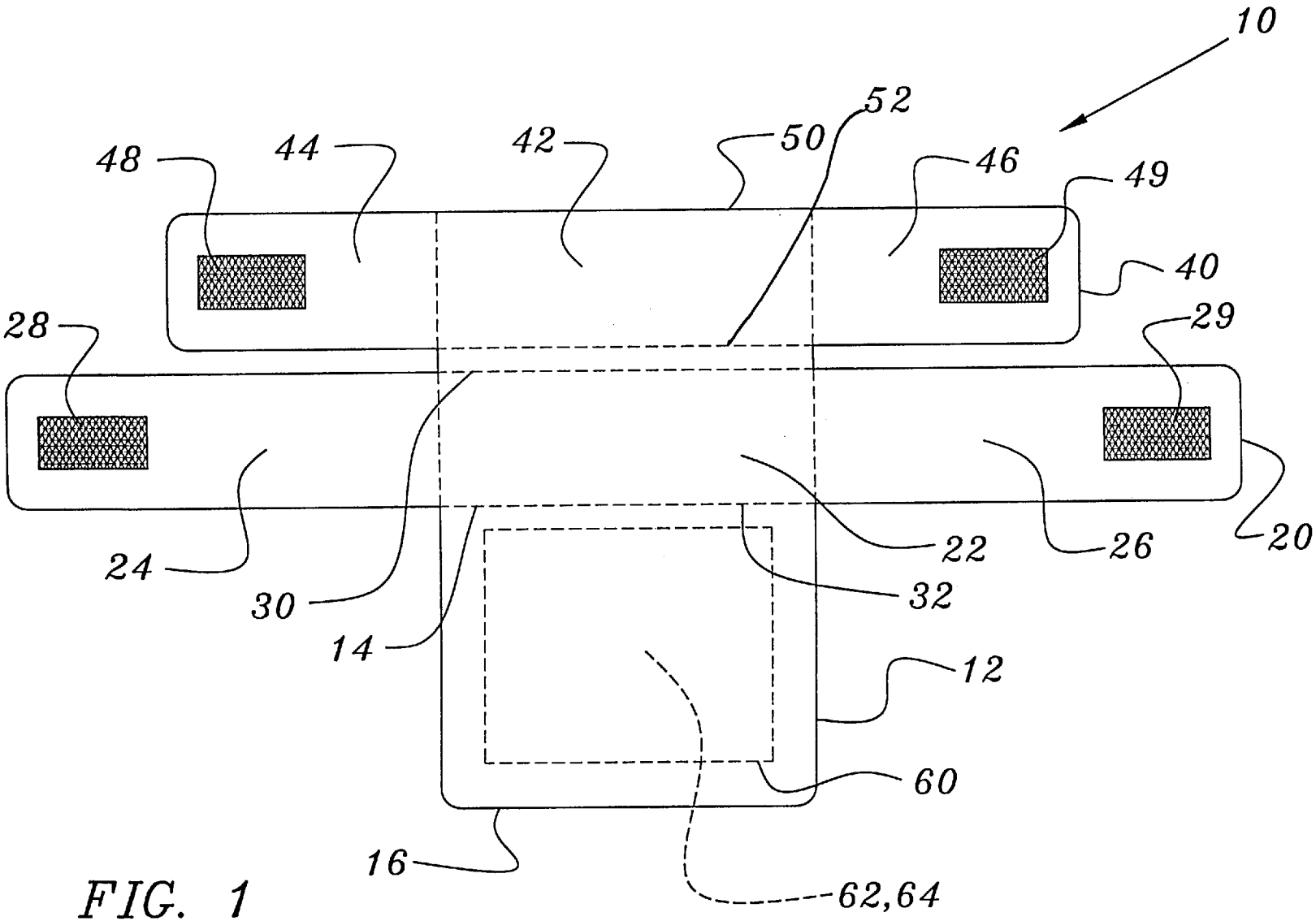
FIG. 1 is a front elevational view of the scarf of the present invention.

Reference will now be made to the drawings, wherein numeral 10 designates a scarf in accordance with the present invention. As can be seen in FIG. 1, the scarf 10 generally comprises a back portion 12, a chest portion 20 and a neck portion 40.

The back portion 12 has an upper end 14 and a lower end 16. The chest portion 20 has a middle chest portion 22, a left chest portion 24 and a right chest portion 26. The neck portion 40 has a middle neck portion 42, a left neck portion 44 and a right neck portion 46.

In a preferred embodiment, the left chest portion 24 and the right chest portion 26 extend equally from the middle chest portion 22. In addition, the left neck portion 44 and the right neck portion 46 extend equally from the middle neck portion 42.

In another preferred embodiment, the middle chest portion 22 has an upper end 30 and a lower end 32. The middle neck portion 42 has an upper end 50 and a lower end 52. Whereby, the upper end 14 of the back portion 12 is integrally connected and centered relative to the lower end 32 of the middle chest portion 22; and the upper end 30 of the middle chest portion 22 is integrally connected and centered relative to the lower end 52 of the middle neck portion 42.

The back portion 12 has a generally square shape, while the neck portion 40 and the chest portion 20 are generally rectangular. The place of connection between the back portion 12 and the chest portion 20 may be rounded or straight, forming a 90 degree angle between the back portion 12 and the chest portion 20. The place of connection between the chest portion 20 and the neck portion 40 is generally rounded.

In order to properly cover a person's neck, the left neck portion 44 and the right neck portion 46 are manufactured out of a flexible material. In use, the middle neck portion 42 is placed against the back of the person's neck and the left neck portion 44 and the right neck portion 46 are connected in the front of the person's neck.

In order to properly cover the person's upper chest, the left chest portion 24 and the right chest portion 26 are manufactured out of a flexible material. In use, the middle chest portion 22 is placed across the shoulders and the back of the lower neck of the person and the left neck portion 44 and the right neck portion 46 are connected on the upper chest of the person.

In addition, the left chest portion 24 and the right chest portion 26 have a first fastening means 28, 29 mounted at the respective ends of the left chest portion 24 and the right chest portion 26. The left neck portion 44 and the right neck portion 46 have a second fastening means 48, 49 mounted at the respective ends of the left neck portion 44 and the right neck portion 46. Both the first fastening means 28, 29 and the second fastening means 48, 49 include Velcro®, snaps, hooks, loops, buttons, zippers and other known fasteners.

In another preferred embodiment, the left chest portion 24 and the right chest portion 26 join together on the upper part of a person's chest through the use of a first hook & loop type fastener 28, 29, thereby covering the person's upper chest without the use of a conventional knot.

In another preferred embodiment, the left neck portion 44 and the right neck portion 46 join together in the front of the person's neck through a second hook & loop type fastener 48, 49, thereby covering the person's neck without the use of a conventional knot.

As a result of connecting the chest portion 20 and the neck portion 40, the back portion 12 overlays the person's back without the use of a conventional knot.

In another preferred embodiment, the back portion 12 has a pouch 60 that can hold either a cooling material 62 or a warming material 64 that provides cooling or warming to the person's back, respectively.

FIGS. 2 through 6 show the intermediary and final steps involved in placing and fastening the present invention upon a person's body.

Figure 2:
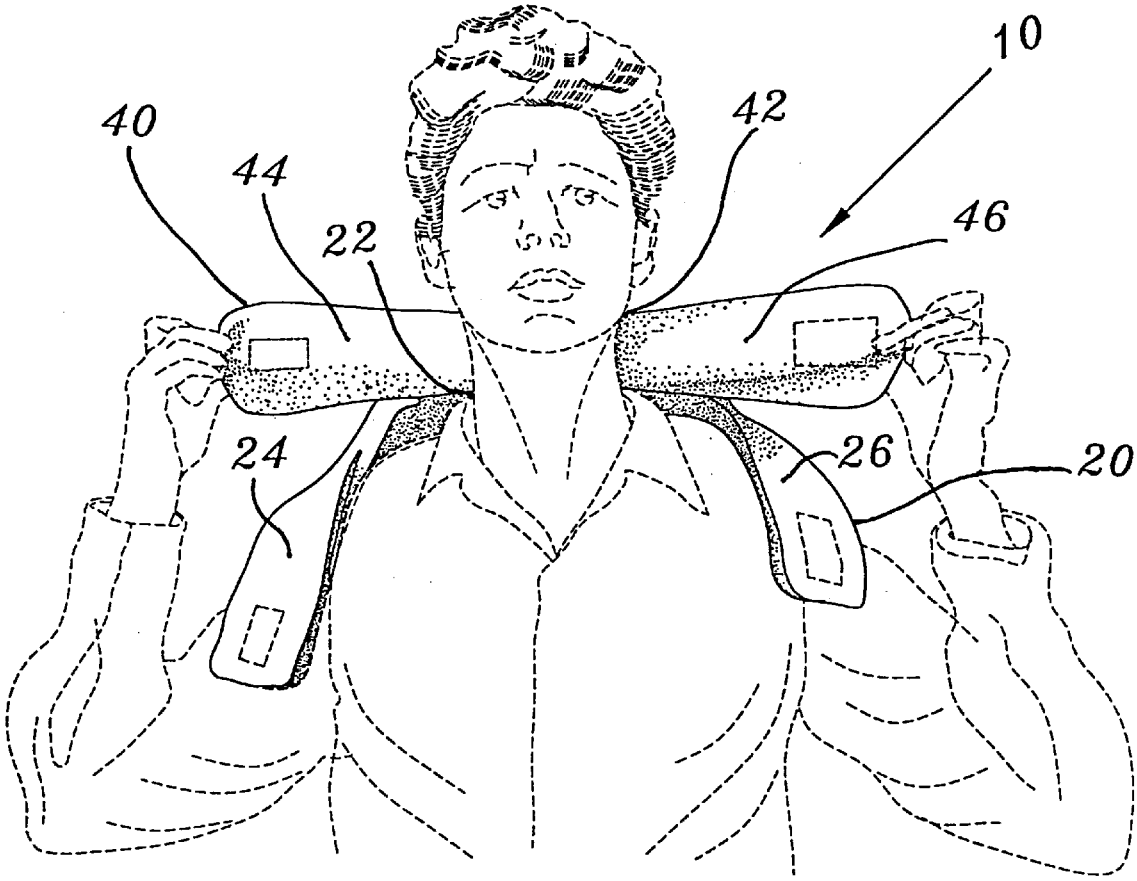
FIG. 2 is a frontal view of the present invention when first placed on a person's body.

Accordingly, as best shown in FIG. 2, the first step is to place the scarf 10 of the present invention on the person's body in preparation for appropriate fastening. The neck portion 40 of the scarf 10 is placed on the person's body so that the middle neck portion 42 is against the back of the person's neck. The chest portion 20 of the scarf 10 is placed on the person's body so that the middle chest portion 22 is across the shoulders of the person. The left chest portion 24 and right chest portion 26 are shown laying in an open extended position in front of the person, thereby unattached.

The person is shown holding the left neck portion 44 and the right neck portion 46 at their respective ends in preparation for fastening around the person's neck.

Figure 3A:
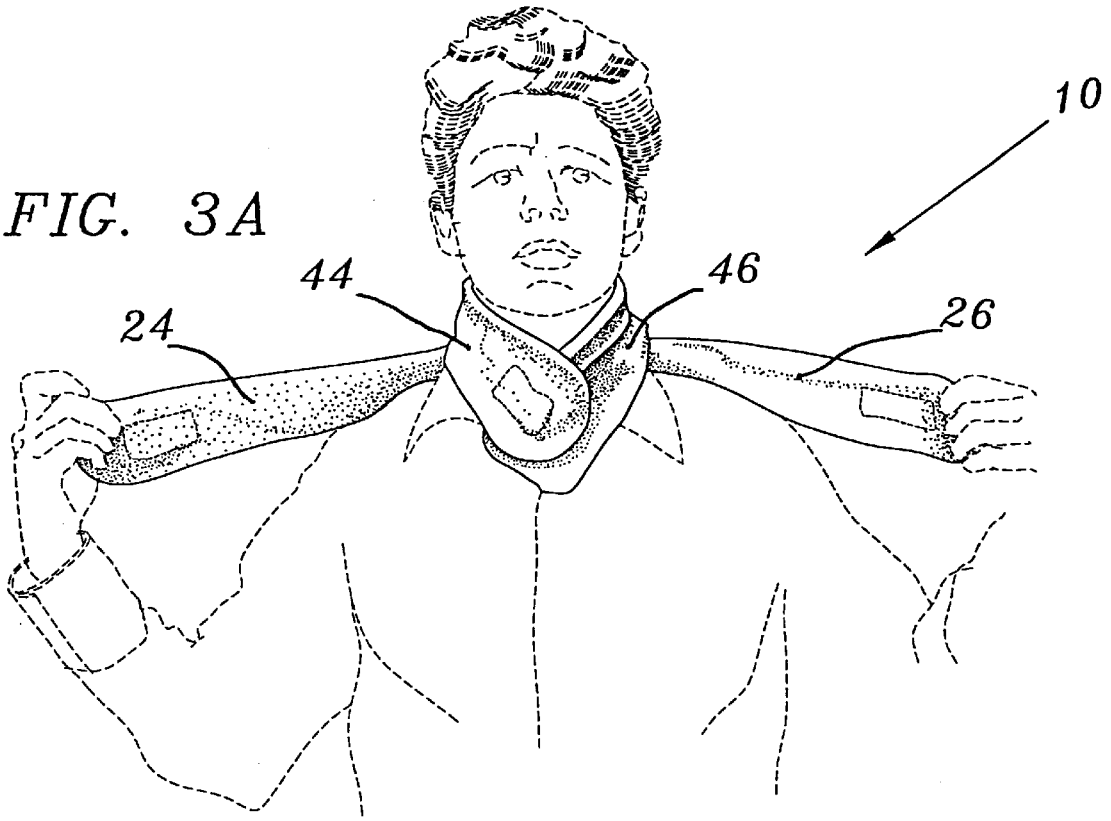
FIG. 3A is a frontal view of the present invention when only the neck portion has been connected on the person's body.

FIG. 3A is a continuation from FIG. 2 of the fastening process of the scarf 10 of the present invention to the person's body. As clearly shown in FIG. 3A, the left neck portion 44 and the right neck portion 46 have now been fastened in the front of the person's neck at their respective ends. The next step shown in FIG. 3A, is the person holding the left chest portion 24 and right chest portion 26 at their respective ends in an outstretched position in preparation for fastening around the person's upper chest.

Figure 3B:
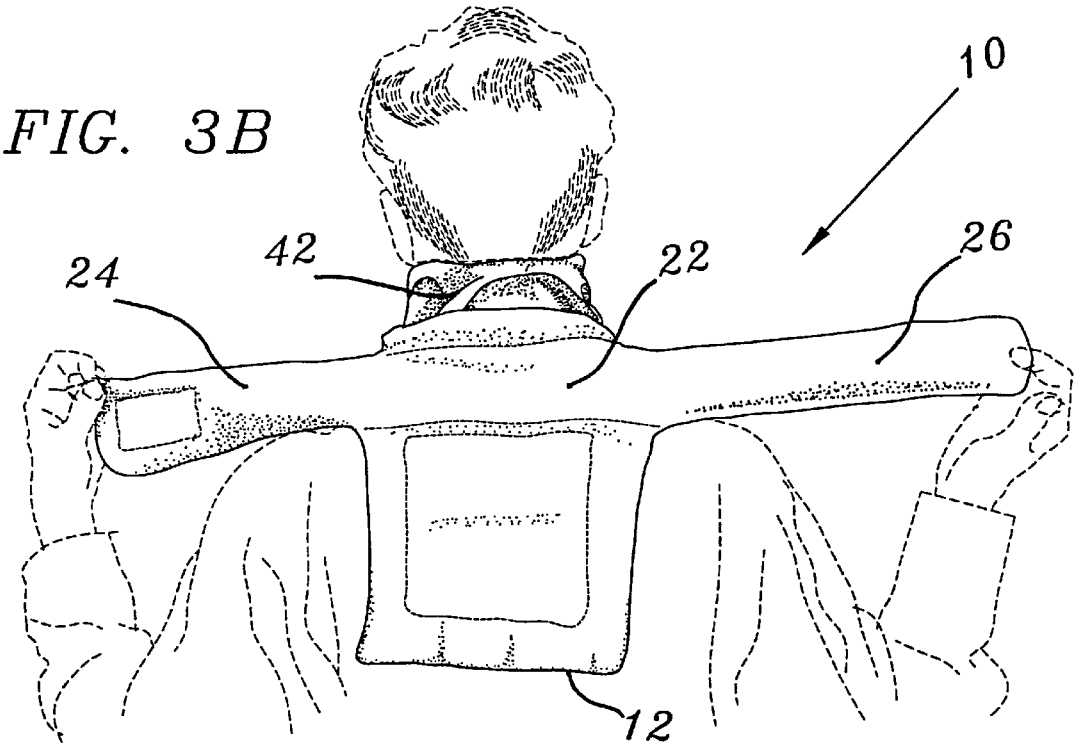
FIG. 3B is a rear view of the present invention when only the neck portion has been connected on the person's body.

Whereas, FIG. 3B shows the scarf 10 of the invention at the same point in the fastening process as FIG. 3A, but from the backside of the person. The middle neck portion 42 is seen placed against the back of the person's neck. Again, the person is holding the left chest portion 24 and right chest portion 26 at their respective ends in preparation for fastening around the person's upper chest. In addition, in FIG. 3B, the back portion 12 is shown laying against the person's back extending downward from the middle chest portion 22.

Figure 4:
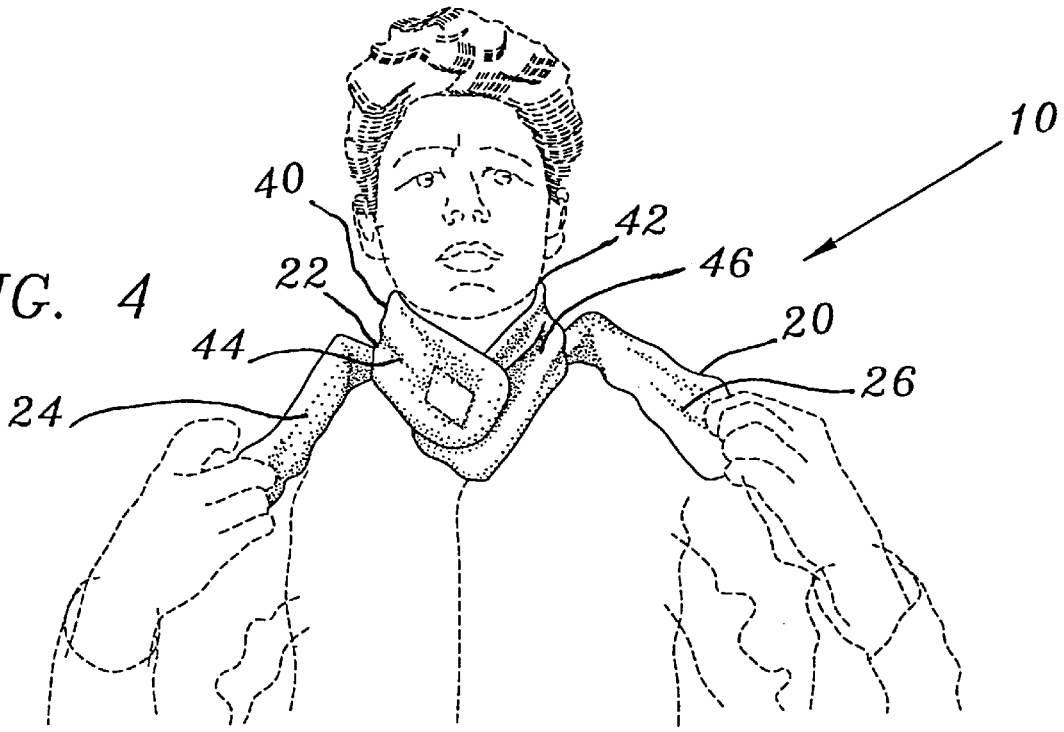
FIG. 4 is a frontal view of the present invention when the chest portion is about to be attached on the person's body.

FIG. 4 is a continuation from FIG. 3A of the fastening process of the scarf 10 of the present invention to the person's body. As clearly shown in FIG. 4, the neck portion 40 of the scarf 10 has the middle neck portion 42 placed against the back of the person's neck. The left neck portion 44 and the right neck portion 46 have been fastened in the front of the person's neck at their respective ends. The chest portion 20 of the scarf 10 has the middle chest portion 22 placed across the shoulders of the person. The next step shown in FIG. 4, is the person holding the left chest portion 24 and right chest portion 26 at their respective ends and in the process of bringing the left chest portion 24 and right chest portion 26 at their respective ends forward across the shoulders in preparation for fastening around the person's upper chest.

Figure 5:
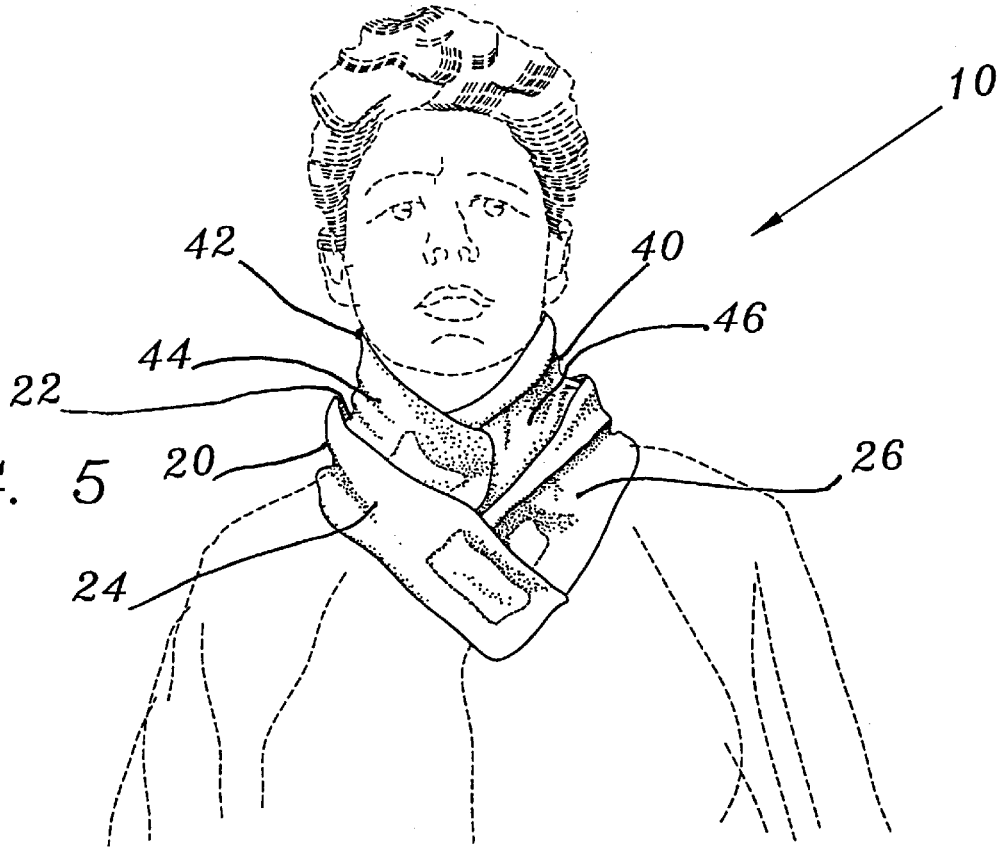
FIG. 5 is a frontal view of the present invention when the neck portion and chest portion have been connected on the person's body.

FIG. 5 is a continuation from FIG. 4 of the fastening process of the scarf 10 of the present invention to the person's body. As clearly shown in FIG. 5, the scarf 10 of the present invention has been completely fastened on the person's body. The neck portion 40 of the scarf 10 has the middle neck portion 42 placed against the back of the person's neck. The left neck portion 44 and the right neck portion 46 have been fastened at their respective ends in the front of the person's neck. The chest portion 20 of the scarf 10 has the middle chest portion 22 placed across the shoulders of the person. The left chest portion 24 and right chest portion 26 have been fastened at their respective ends in the front of the person to cover the person's upper chest.

As can be easily appreciated, the design on the fabric itself, the fabric from which the scarf is made, as well as dimensions of the square and rectangular portions, depending on the taste and intentions of the user, can be changed indefinitely.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, I claim:

1. A back, neck and chest scarf comprising:

a back portion having an upper end and a lower end;

a chest portion having a middle chest portion, a left chest portion and a right chest portion, said left chest portion and said right chest portion extending equally from said middle chest portion;

said left chest portion and said right chest portion having a first hook & loop type fastener positioned at the respective ends of said left chest portion and said right chest portion;

said middle chest portion having an upper end and a lower end;

a neck portion having a middle neck portion, a left neck portion and a right neck portion of a generally rectangular configuration with a height to cover a person's neck, said left neck portion and said right neck portion extending equally from said middle neck portion;

said left neck portion and said right neck portion having a second hook & loop type fastener positioned at the respective ends of said left neck portion and said right neck portion;

said middle neck portion having an upper end and a lower end;

said upper end of said back portion being integrally connected and centered relative to said lower end of said middle chest portion;

said upper end of said middle chest portion being integrally connected and centered relative to said lower end of said middle neck portion;

said left chest portion and said right chest portion joining together on the upper part of a person's chest through said first hook & loop type fastener, thereby covering the person's upper chest without the use of a conventional knot; and said left neck portion and said right neck portion joining together in the front of the person's neck through said second hook & loop type fastener, said height of said rectangular configuration of said neck portion covering the person's neck.

2. A back, neck and chest scarf comprising:

a back portion having an upper end and a lower end;

a chest portion connected relative to said upper end of said back portion; and a neck portion connected relative to said chest portion, said neck portion of a generally rectangular configuration with a height to cover a person's neck, said height of said rectangular configuration of said neck portion covering the person's neck.

3. The scarf according to claim 2, wherein said back portion is centered relative to said neck portion and said chest portion.

4. The scarf according to claim 2, wherein the neck portion further comprises:

a middle neck portion;

a left neck portion; and a right neck portion, whereby said left neck portion and said right neck portion join together in the front of the person's neck.

5. The scarf according to claim 4, wherein said left neck portion and said right neck portion extend equally from said middle neck portion.

6. The scarf according to claim 5, wherein said left neck portion and said right neck portion being made of a flexible material.

7. The scarf according to claim 6, wherein said left neck portion and said right neck portion further comprise a first fastening means mounted at the respective ends of said left neck portion and said right neck portion.

8. The scarf according to claim 7, wherein the first fastening means includes a hook & loop, snaps, hooks, loops, buttons, zippers and other known fasteners.

9. The scarf according to claim 2, wherein the chest portion further comprises:

a middle chest portion;

a left chest portion; and a right chest portion, whereby said left chest portion and said right chest portion join together on the upper part of the person's chest.

10. The scarf according to claim 9, wherein said left chest portion and said right chest portion extend equally from said middle chest portion.

11. The scarf according to claim 10, wherein said left chest portion and said right chest portion being made of a flexible material.

12. The scarf according to claim 10, wherein said left chest portion and said right chest portion further comprise a second fastening means mounted at the respective ends of said left chest portion and said right chest portion.

13. The scarf according to claim 12, wherein the second fastening means includes a hook & loop, snaps, hooks, loops, buttons, zippers and other known fasteners.

14. The scarf according to claim 2, wherein said back portion further comprises a pouch.

15. The scarf according to claim 14, wherein said pouch allows a cooling material to fit within said pouch thereby providing cooling to the person's back.

16. The scarf according to claim 14, wherein said pouch allows a warming material to fit within said pouch thereby providing warmth to the person's back.

* * * * *